United States Patent [19]

Walker et al.

[11] Patent Number: 5,016,395

[45] Date of Patent: May 21, 1991

[54] BOXCAR DOOR HAVING BALSA CORE SANDWICH CONSTRUCTION

[75] Inventors: Del E. Walker, Lake Quivira; Stephen R. Early, Olathe, both of Kans.

[73] Assignee: Aera Transportation Products, Inc., Kansas City, Mo.

[21] Appl. No.: 341,207

[22] Filed: Apr. 21, 1989

[51] Int. Cl.[5] ..... E06B 3/00

[52] U.S. Cl. ..... 49/501; 52/829; 52/630

[58] Field of Search ..... 49/501; 52/630, 829, 52/830

[56] References Cited

U.S. PATENT DOCUMENTS 2,781,875 2/1957 Noel et al. ..... 49/486

3,950,894 4/1976 DiMaio ..... 49/501

4,802,319 2/1989 Lafleur ..... 49/501

FOREIGN PATENT DOCUMENTS 0261267 10/1960 Australia ..... 49/501

*Primary Examiner*—Peter R. Brown

*Assistant Examiner*—Gerald Anderson

[57] ABSTRACT

A door for railroad boxcars has a balsa core sandwich construction in which a balsa core is sandwiched between thin fiberglass skins and reinforced at the perimeter by steel tubes to provide an economical and lightweight door that exhibits the requisite structural strength. The door has a concavo-convex configuration that prevents thermally induced warpage from deforming the door in a manner to cause significant interference in its opening and closing movement.

7 Claims, 1 Drawing Sheet

BOXCAR DOOR HAVING BALSA CORE SANDWICH CONSTRUCTION

BACKGROUND AND SUMMARY OF THE INVENTION

This invention relates generally to railroad equipment and more particularly to a sliding boxcar door having a unique construction in which a balsa core is sandwiched between two fiberglass skins and reinforced at the periphery by rigid metal edged stiffeners.

In the past, railroad boxcars have been equipped with steel doors which are expensive, heavy and difficult to handle. Because of the difficulty involved in sliding steel boxcar doors open and closed, machines such as forklifts are commonly used to assist in the opening and closing of the door. The forklift is often jammed into the door, thus causing it to bend and making it even harder to open and close as well as creating other problems.

The present invention is directed to a novel boxcar door having a unique construction which is lighter in weight than a steel door and which avoids other problems associated with the conventional steel boxcar door. In accordance with the invention, a boxcar door panel is constructed by sandwiching a balsa core between two thin fiberglass skins. The edges of the panel are strengthened by steel tubes which are enclosed by the fiberglass skins. By virtue of this construction, advantage is taken of the low cost and light weight of balsa and fiberglass, while the steel tubes provide structural strength and rigidity at the door edges which are the most vulnerable areas of the door.

It is a special feature of the invention that the door panel is constructed with a built-in curvature providing it with a concavo-convex configuration that counteracts the effects of thermally induced warpage. The concave side faces inwardly so that when the outside of the door is heated, the thermal distortion that is thereby induced does not cause the door to bow inwardly beyond the plane of the door frame. As a consequence, thermal warpage does not deform the door enough to cause it to interfere with the door frame and possibly create difficulty in opening and/or closing of the door.

In the accompanying drawings which form a part of the specification and are to be read in conjunction therewith and in which like reference numerals are used to indicate like parts in the various views.

DETAILED DESCRIPTION OF THE INVENTION

Figure 2:
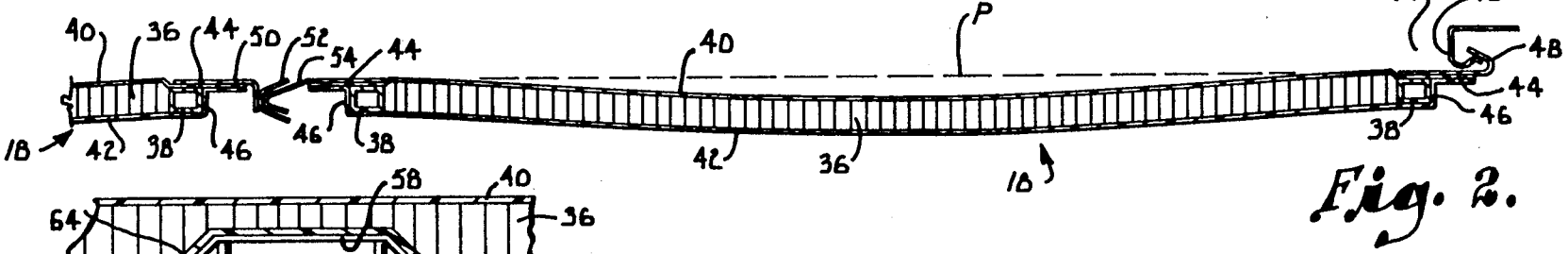
FIG. 2 is a fragmentary sectional view on an enlarged scale taken generally along line 2—2 of FIG. 1 in the direction of the arrows and showing the curvature of one of the boxcar door on an exaggerated scale.

Referring now to the drawings in more detail, numeral 10 generally designates a conventional railroad boxcar having a side 12 which presents the usual rectangular door opening 14 (see FIG. 2 in particular). The frame of the door opening including a bent flange 16 which extends along each side edge of the door opening 14. The door opening 14 of the boxcar 10 is normally closed by a pair of sliding door panels which are each generally identified by reference numeral 18.

Figure 1:
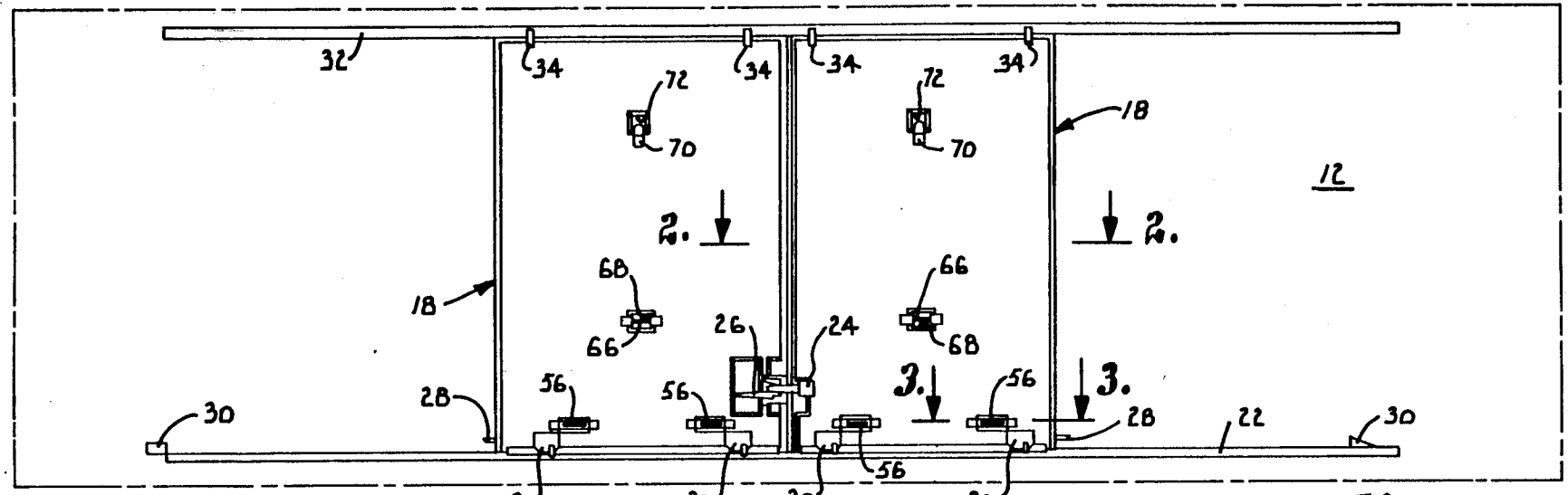
FIG. 1 is a side elevational view of a railroad boxcar equipped with a pair of sliding boxcar doors constructed in accordance with the present invention.

The two door panels 18 are constructed similarly, and each includes a pair of wheel assemblies 20 at the bottom which ride along a horizontal track 22 mounted on the boxcar side 12. In this manner, the doors 18 may slide on track 22 between the closed position shown in FIG. 1 wherein the edges of the doors 18 abut one another and the doors cooperate to close the door opening 14 and a fully open position in which the doors 18 are moved outwardly away from one another to fully expose the door opening 14 so that freight can be loaded or unloaded. A hasp 24 and lock 26 are provided to allow the doors to be secured in the closed position. The outer edge of each door 18 is provided with a slotted bar 28 and the bars 28 are engaged on catches 30 to hold the doors in the open positions.

A second horizontal track 32 extends on the boxcar side 12 at a location above the doors 18. Retainers 34 mounted on the upper edges of doors 18 ride along the track 32 to help hold the doors on the boxcar in the proper position.

As previously indicated, the two doors 18 have substantially the same construction, although there may be relatively minor differences, including differences in the width dimension. For example, one door is normally referred to as the main door (the door that appears on the right in FIG. 1) while the other door is commonly referred to as the auxiliary door (the door that is on the left as viewed in FIG. 1).

The construction of each door 18 is best shown in FIG. 2. The body of each door panel 18 is formed by a balsa core 36 which may be either a balsa wood sheet or a series of individual balsa wood blocks having a backing referred to as a "scrim" backing. A scrim backed balsa core facilitates contouring and shaping of the balsa, although a continuous balsa sheet can also be used and permits curving of the core 36 as required. The core 36 is generally rectangular.

In order to stiffen, strengthen and structurally reinforce the periphery or perimeter of the balsa core 36, rectangular steel tubes 38 extend along both side edges and the top and bottom edges of each core 36. The steel tubes 38 are rectangular in cross section as shown in FIG. 2 and provide a rigid rectangular frame which extends substantially continuously around the perimeter of the balsa core 36. The steel tubes 38 are interconnected and define a flat plane P (FIG. 2) which is parallel to the plane defined by the frame surrounding the door opening 14 of the boxcar.

Each door panel 18 includes a fiberglass skin which encloses the balsa core 36 and the steel tubes 38 and which includes an inside fiberglass skin 40 and an outside fiberglass skin 42. The fiberglass skins 40 and 42 are relatively thin layers of fiberglass preferably about ⅛ inch thick. The inside skin 40 extends along and covers the inside surface of the balsa core 36 and includes flat peripheral flanges 44 which cover the insides of the tubes 38 and project slightly beyond the tubes.

The outside skin 42 extends along and covers the outside surface of the balsa core 36 and also covers the outside of the tubes 38. L shaped flanges 46 are formed on the outside edges of skin 42 and serve to enclose the tubes 38. The flanges 46 also mate with and are secured to the flanges 44 of the inside skins 40 at the perimeter of the door panel.

The outside edge of each door panel 18 is provided with a spark strip 48 which has a hook-like shape in section. The spark strip 48 is secured to the adjacent flange 44 and is located and arranged to receive and mate with the flange 16 when the door panel is closed, as shown in FIG. 2. The cooperative fit between the spark strip 48 and flange 16 serves to inhibit leakage of dirt and moisture into the interior of the boxcar through the door opening 14.

The inside edge of one of the door panels 18 (the door panel which is on the left as viewed in FIG. 1) is provided with an L shaped bracket 50 which is secured to the adjacent flange 44. Mounted on the bracket 50 is a female meeting strip 52 which is located and arranged to receive a male meeting strip 54 on the other door panel in the closed positions of the doors. The male meeting strip 54 is secured to the adjacent flange 44 of the right hand door panel 18 and is closely received in the female meeting strip 52 in the manner shown in FIG. 2. The cooperative fit between the meeting strips 52 and 54 inhibits the entry of dirt and moisture between the closed doors. The spark strips and meeting strips on the perimeter of the door are secured by bolts or rivets through flange 44 and are blind fastened from the inside into the steel tube frame by means of blind rivets or self-tapping screws.

The outer face of each door panel is provided with various accessory brackets, including a pair of come-along puller handles 56 located near the lower edge of each door. Each puller handle 56 is a C shaped bar which is mounted in a recess 58 in the door panel. Each puller handle 56 extends from a mounting plate 80 which is bent to conform to the shape of the recess 58 and which is secured to the door panel 18 by suitable fasteners 62. Each recess 58 has opposite sides 64 which angle from the base of the recess to the outer surface of the door panel 18 at an angle of approximately 45°.

The purpose of the come-along puller handles 56 is to permit a ratchet-type device known as a come-along puller to be used to pull the door panels 18 open and closed. The 45° angle at which the recess side 64 extend is significant in that it voids 90° angles or other sharp corners on which forklifts or other machinery can become caught and possibly cause damage.

Figure 3:
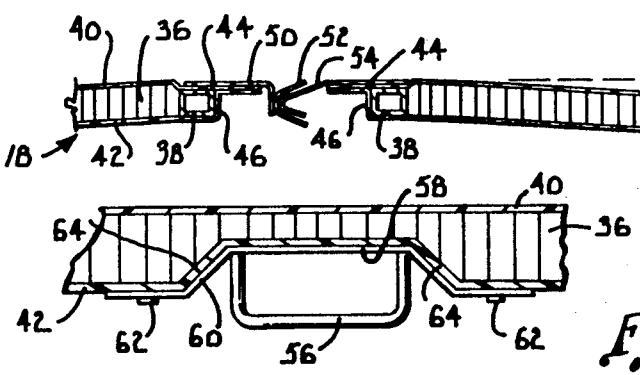
FIG. 3 is a fragmentary sectional view on an enlarged scale taken generally along line 3—3 of FIG. 1 in the direction of the arrows.

Additional accessories include a grab iron 66 on each door. Each grab iron is mounted in a recess 68 having a configuration similar to the recess 58 shown in FIG. 3. The grab irons provide handles by which the doors can be grasped manually to open and close them.

Each door panel 18 also includes a lifting lug 70 which presents an opening to receive the tackle of a crane or other equipment used to install or otherwise handle the doors. The lifting lugs 70 are mounted adjacent to recesses 72 having configurations similar to the recess 58 shown in FIG. 3.

It is a particularly important feature of the invention that each door panel 18 is constructed in a bowed manner given it a concavo-convex configuration which is shown in an exaggerated manner in FIG. 2 for purposes of illustration. The inside surface of the door panel 18 is a concave surface and gradually curves from both side edges and the top and bottom edges toward the center, which is normally offset from the plane P defined by the flanges 44. It has been found that good results are achieved when the center of the inside surface of the door panel is offset from the plane P by approximately ¾ inch. The interior of the door is generally flush and smooth with no protruding ridges or fasteners. This is necessary so that if boxes of product in the rail car fall against the door, the door can still slide open and not catch on the box.

The opposite or outside surface of the door panel 18 is a convex surface which has the same curvature as the concave inside surface such that the door panel 18 as a whole has a concavo-convex shape with the convex surface facing outwardly and the concave surface facing inwardly.

The concavo-convex shape of the door panel 18 is significant in that it permits the door panel 18 to undergo thermally induced warpage without adversely affecting the operational characteristics of the door. In service, the boxcar 10 may be exposed to temperatures that vary between approximately −20° F. and 100° F. During the day, the outside surface of the door panel is heated and becomes warmer than the inside surface, thus inducing thermal distortion which tends to cause the door to warp inwardly near the center. It is noted that the presence of the rigid steel tubes 38 on the periphery of the door panel prevent significant thermal distortion near the perimeter. Because of the concavo-convex shape of the door panel 18, its center is displaced outwardly from the plane P initially. Consequently, when the center portion of the door panel bows inwardly due to the thermally induced warpage, it still remains either on or outwardly of the plane P and does not warp inwardly beyond plane P even under the most severe thermal conditions to which it is subjected in service.

Because the panel does not warp inwardly beyond plane P, it can be opened and closed without interfering with the flanges 16 or other parts of the door frame. Flat door panels have been constructed, and it has been found that thermally induced warpage can deform the door inwardly far enough to create such interference, and significant difficulties in opening and closing the doors are presented in this circumstance. Since the concavo-convex shape of the door panel 18 avoids this problem, the panel should be constructed with this shape or there can be thermally induced problems with the operation of the doors.

The balsa core sandwich construction door panels 18 are mounted on the boxcar 10 in the same manner as conventional steel doors, and they operate in substantially the same manner as conventional steel doors. However, because of use of the balsa core 36 and the fiberglass skins 40 and 42, with steel being used only at the perimeter, the doors 18 are considerably lighter in weight and more easily handled than conventional steel doors. At the same time, the door is strong enough to withstand the forces to which it is subjected in normal use and potential thermal problems are countered by the concavo-convex configuration in which the door is constructed It should be noted that the door construction is applicable to boxcars which have only one door on each side. It should also be noted that the doors can be top hung doors in which top mounted wheels on the door ridge along overhead tracks. These and other construction and application variations are contemplated by and within the scope of the present invention.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A boxcar door for a railroad boxcar, comprising:

a generally rectangular balsa core having opposite inside and outside surfaces and a generally rectangular periphery including opposite side edges and top and bottom edges, said core having a balsa wood construction and curving both from one side edge to the other side edge and from said top edge to said bottom edge to provide said inside surface with a concave configuration and said outside surface with a convex configuration;

rigid stiffeners extending around the periphery of said balsa core and defining a common plane; and a fiberglass skin substantially enclosing said balsa core and said stiffeners, said skin comprising a pair of fiberglass sheets extending along and conforming in curvature with the respective inside and outside surfaces of said core and having edges mating with one another adjacent said periphery.

2. The boxcar door of claim 1, wherein each stiffener comprises a rigid tube.

3. The boxcar door of claim 1, wherein each stiffener comprises a rigid metal tube having a substantially rectangular cross section.

4. In a railroad boxcar having a side opening, a sliding door construction comprising:

a door panel mounted on the boxcar for sliding movement to control the exposure of said side opening;

a balsa core forming the body of said door panel, said core presenting inside and outside surfaces and a generally rectangular periphery including opposite side edges and top and bottom edges;

said core being curved from one side edge to the other and from the top edge to the bottom edge to provide said inside surface with a concave configuration and said outside with a convex configuration;

rigid stiffeners on said door panel extending around said periphery to stiffen and reinforce the door panel at the perimeter thereof, each stiffener comprising a rigid metal tube and each tube having a face which occupies a plane common to the faces of the other tubes; and a fiberglass skin enclosing said core and comprising an inside skin covering and conforming with the curvature of said inside surface of the balsa core and an outside skin covering and conforming with the curvature of said outside surface of the balsa core, said inside and outside skins having edge portions covering said stiffeners and mating adjacent to the periphery of the core.

5. The door construction of claim 4, wherein each of said tubes substantially rectangular cross section.

6. A door construction for a railroad boxcar, comprising a door panel having a substantially rectangular balsa core sandwiched between a pair of thin fiberglass skins, said door panel having a periphery reinforced by rigid stiffeners which are enclosed by said skins and which have faces occupying a common plane and said door panel having a convex outside surface and a concave inside surface to resist thermally induced warpage tending to bow the door panel inwardly, said inside and outside surfaces both curving from side to side and also from top to bottom.

7. The door construction of claim 6, wherein each of said stiffeners comprises a rigid metal tube.

* * * * *